US005084740A

United States Patent [19]

Simizu

[11] Patent Number: 5,084,740

[45] Date of Patent: Jan. 28, 1992

[54] IMAGE RECORDING APPARATUS WITH HIGH VOLTAGE SUPPLY CURRENT STABILIZING CIRCUIT

[75] Inventor: Katsuo Simizu, Saitama, Japan

[73] Assignee: Fuji Xerox Co., Ltd., Tokyo, Japan

[21] Appl. No.: 616,566

[22] Filed: Nov. 21, 1990

[30] Foreign Application Priority Data

Jan. 19, 1990 [JP] Japan ..... 2-10202

[51] Int. Cl.[5] ..... G03G 21/00

[52] U.S. Cl. ..... 355/315; 355/219; 361/235

[58] Field of Search ..... 355/219, 315, 221; 361/229, 235, 230; 250/324, 325, 326; 363/125, 126; 307/11, 12, 31, 33

[56] References Cited

FOREIGN PATENT DOCUMENTS 58-129448 8/1983 Japan ..... 355/315

63-221365 9/1988 Japan ..... 355/219

*Primary Examiner*—A. T. Grimley

*Assistant Examiner*—Shuk Lee

*Attorney, Agent, or Firm*—Finnegan, Henderson, Farabow, Garrett and Dunner

[57] ABSTRACT

An image recording apparatus in which a constant current is supplied from a high voltage source to a charging unit to charge a photo-sensitive material, and the constant current is further supplied to a peeling unit to peel a printing sheet off the photo-sensitive material on which an image has been recorded is provided with a high voltage supply current stabilizing circuit which comprises; a first resistor for stabilizing a constant current supplied to the peeling unit, the first resistor being larger in resistance than the peeling unit; and a second resistor for stabilizing a constant current supplied to the charging unit when the resistance of the first resistor is larger than the resistance of the peeling unit, whereby a constant current is stably supplied to the peeling unit even when the resistance of the latter changes.

2 Claims, 2 Drawing Sheets

IMAGE RECORDING APPARATUS WITH HIGH VOLTAGE SUPPLY CURRENT STABILIZING CIRCUIT

BACKGROUND OF THE INVENTION

This invention relates to a high voltage supply current stabilizing circuit for stabilizing constant currents which, in an image recording apparatus, are supplied to the charging unit and the peeling unit from the high voltage source.

A high voltage supply current stabilizing circuit has been employed in an image recording device. In the image recording apparatus, as shown in FIG. 3, a photo-sensitive material 12 is charged with a charging unit 11, to which a constant current is supplied from a high voltage source (not shown), and the output laser beam of a laser oscillating section 13 is applied to the photo-sensitive material 12 thus charged to form a latent image therein. Thereafter, the toner 15 in a developing section 14 is applied to the latent image thus formed, to develop it into a toner image. The toner image is transferred onto a recording sheet 17 with a transferring unit 16, which is conveyed into the apparatus. Upon completion of the transferring of the toner image, a peeling unit 18, to which the high voltage source supplies a constant current, operates to discharge the recording sheet 17 thereby to peel the recording sheet 17 from the photo-sensitive material 12. Thereafter, the recording sheet is ejected from the apparatus.

FIG. 4 shows the high voltage supply current stabilizing circuit for supplying the constant currents from the high voltage source to the charging unit 11 and the peeling unit 18. In FIG. 4, the charging unit 11 and the peeling unit 18 are represented equivalently by load resistors R1 and R3, respectively. The output constant current I of the high voltage source is divided into two constant currents I-i and i. The constant current I-i is supplied to the load resistor R1, and the constant current i is supplied through a current stabilizing resistor R2 to the load resistor R3. The relation between the resistors and the currents are:

$$(R2+R3)i=R1(I-i)=R1I-R1i \quad (1)$$

From equation (1), the current i is:

$$i=R1I/(R1+R2+R3) \quad (2)$$

If it is assumed that the resistances of the load resistors R1 and R3 are 14.4 MΩ and 50 MΩ, respectively, the value of the constant current I is 285 μA, and the resistance of the resistor R2 is 50 MΩ, then, according to equation (2) the current i is:

$$\begin{aligned} i &= 14.4 \times 285/(14.4 + 50 + 50) \\ &= 35.9\ \mu A \end{aligned}$$

However, if the current to the peeling unit 18 becomes higher for instance because of the installation error of the charging unit 16 and the peeling unit 18 (the distance between the two units being reduced), then it may be difficult to satisfactorily transfer the toner image onto the recording sheet 17. Alternatively, if the resistance of the peeling unit 18 is higher because of variations in environmental condition (such as temperature and humidity) of the peeling unit 18 or when the latter is made dirty; more specifically, if the resistance R3 is doubled to 100 MΩ, then according to equation (2) the value of the current i of the peeling unit 18 is decreased to 25 μA, 69.7% of the above-described value. As a result, it becomes rather difficult to smoothly peel the recording sheet 17 off the photo-sensitive material, and a toner explosion may take place.

SUMMARY OF THE INVENTION

In view of the foregoing, an object of this invention is to provide a high voltage supply current stabilizing circuit with which the resistance of the peeling unit in an image recording apparatus changes, a current is stably supplied to the peeling unit, and the occurrence of a toner explosion is positively prevented.

The foregoing object and other objects of the invention have been achieved by the provision of a high voltage supply current stabilizing circuit for an image recording apparatus in which a constant current is supplied from a high voltage source to a charging unit to charge a photo-sensitive material, and the constant current is further supplied to a peeling unit to peel a printing sheet off the photo-sensitive material on which an image has been recorded, which circuit, according to the invention, comprises: a first resistor for stabilizing a constant current supplied to the peeling unit, the first resistor being larger in resistance than the peeling unit; and a second resistor for stabilizing a constant current supplied to the charging unit.

In the stabilizing circuit, as was described above, the first current stabilizing resistor is larger in resistance than the peeling unit, and the resistance of the second current stabilizing resistor is so selected as to stabilize the constant current supplied to the charging unit. Accordingly, the constant current supplied to the peeling unit is stabilized; more specifically, the variation of the constant current flowing to the peeling unit can be minimized even when the resistance of the peeling unit changes.

The nature, principle and utility of the invention will become more apparent when read in conjunction with the accompanying drawings, in which like parts are designated by like reference numerals or characters.

DETAILED DESCRIPTION OF THE INVENTION

Preferred embodiments of this invention will be described with reference to FIGS. 1 and 2.

Figure 1:
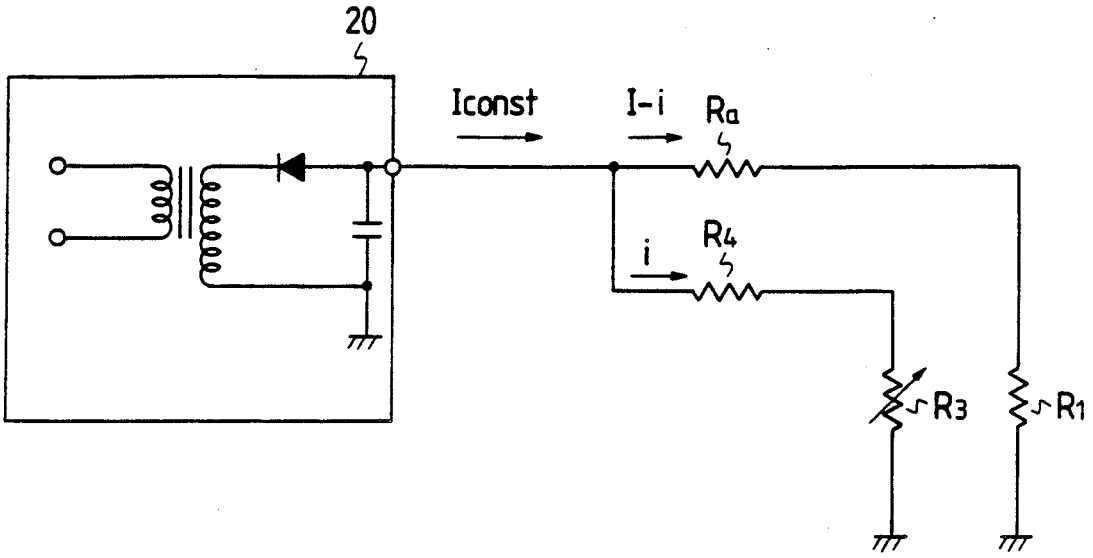
FIG. 1 is a circuit diagram showing one example of a high voltage supply current stabilizing circuit according to this invention.
Figure 2:
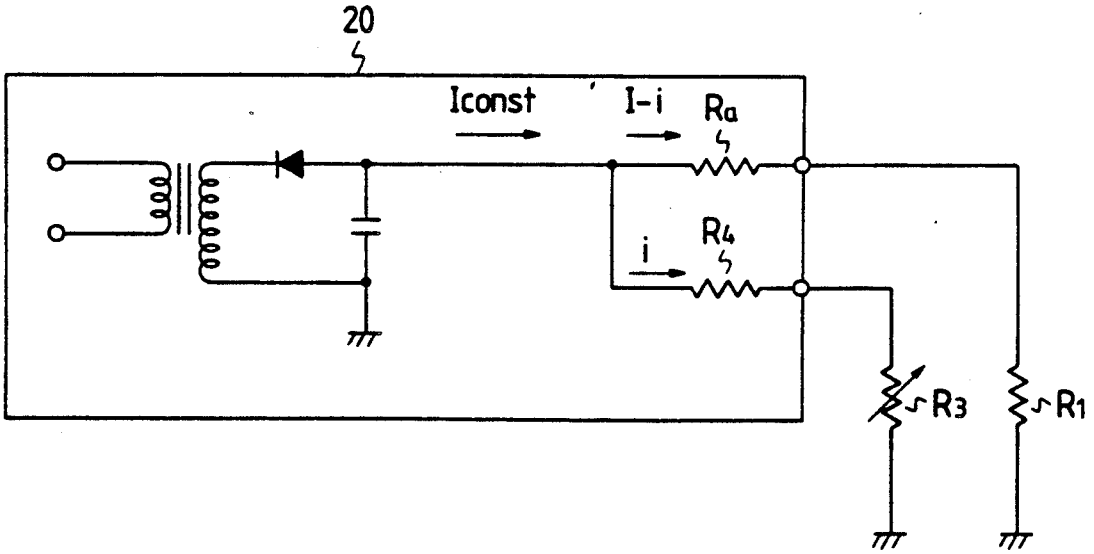
FIG. 2 is a circuit diagram showing another example of the high voltage supply current stabilizing circuit according to the invention.
Figure 4:
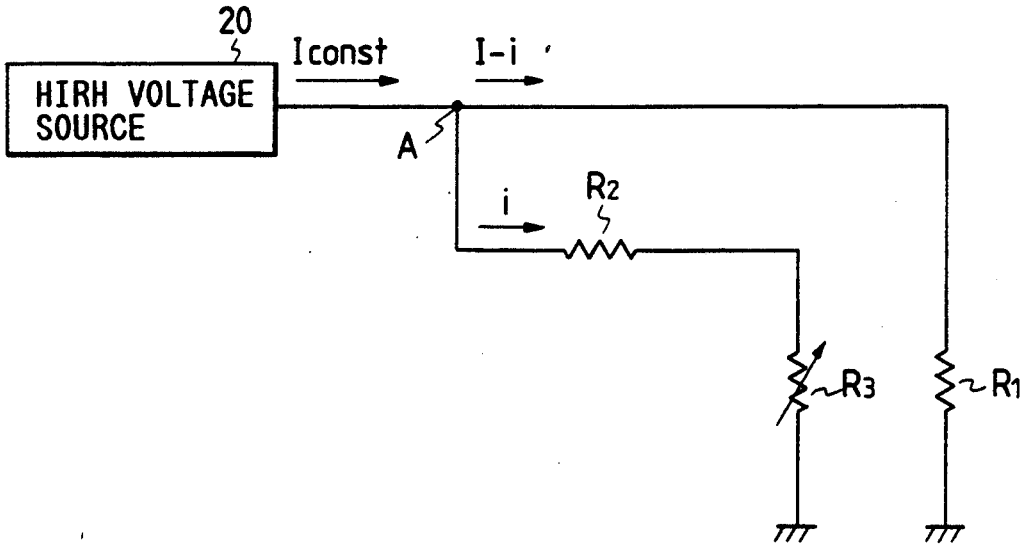
FIG. 4 PRIOR ART
FIG. 4 is a circuit diagram showing a conventional high voltage supply current stabilizing circuit.

A first example of a high voltage supply current stabilizing circuit according to the invention is as shown in FIG. 1, in which those components which have been previously described with reference to FIG. 4 are therefore designated by the same reference numerals or characters.

In the circuit shown in FIG. 1, the resistance of a current stabilizing resistor R4 is higher than that of the load resistor of the peeling unit 18, and another current stabilizing resistor Ra is provided to adjust the increase in resistance of the resistor R4 relative to R2. The resistance of the resistor R4 is higher by $\Delta$R2 than the resistance of the current stabilizing resistor R2 shown in FIG. 4 (i.e., R4 = R2 + $\Delta$R2).

In order to decrease the variation of the current i which is due to the variation in resistance of the load resistor R3, the resistance of the resistor R4 is so determined as to meet R4 >> R3. In this case, it is necessary to maintain the currents i and I-i constant in order to drive the loads. (In the case of FIG. 4, the current i is 35.9 $\mu$A)

When the resistor R4 is set to R4 >> R3, the resistor Ra for compensating the increment $\Delta$R2 of the resistance of the resistor R4 is required. Then, following equations are established.

$$(R4 + R3)i = (Ra + R1)(I - i) \quad (3)$$
$$Ra + R1 = (Ra + R3)i/(I - i)$$
$$Ra = \{(R4 + R3)i/(I - i)\} - R1$$

It is assumed that, similarly as in the above-described case of the conventional stabilizing circuit, the resistances of the load resistors R1 and R3 are 14.4 M$\Omega$ and 50 M$\Omega$, respectively, the value of the constant current I is 285 $\mu$A, and the resistance of the resistor R4 is 100 M$\Omega$. In order to obtain the current i = 35.9 $\mu$A which is the same as the above-described conventional case, the resistance of the resistor Ra becomes as follows:

From equation (3), $$Ra = \{(100 + 50) \times 35.9/(285 - 35.9)\} - 14.4$$
$$= 7.2(\text{M}\Omega)$$

When, similarly as in the case of the conventional stabilizing circuit, the load resistance R3 is doubled to 100 M$\Omega$ for instance because the contamination of the peeling unit, then the current i is 27.7 ($\mu$A) which is obtained from the equation (3). That is, it is reduced 77.1%, thus being improved 7.4% when compared with that in the conventional stabilizing circuit.

The higher resistance of the resistor R4 can reduce the variation of the current i more effectively. However, the resistance of about 100 M$\Omega$ is preferably selected for the above-described embodiment because of the performance of the high voltage power supply or the safety.

Figure 3:
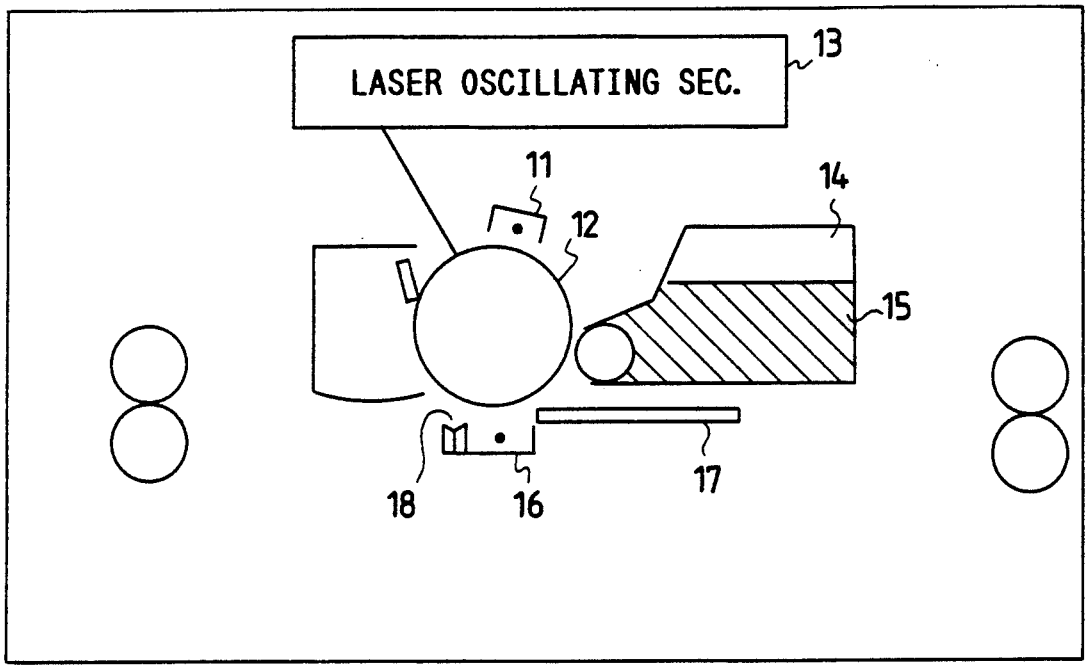
FIG. 3 is an explanatory diagram outlining the arrangement of an image recording apparatus using a high voltage supply current stabilizing circuit.

As is apparent from the above description, in the stabilizing circuit, the resistances of the current stabilizing resistors R4 and Ra can be so selected as to minimize the variation of the current i flowing in the peeling unit. Accordingly, the current supplied to the peeling unit can be maintained stable even when the resistance of the load resistor R3 (equivalent to the peeling unit) is changed because of the installation error of the peeling unit and the charging unit or contamination of the peeling unit or variations in environmental condition (such as temperature or humidity) of the same. Accordingly, in the image recording apparatus shown in FIG. 3, the toner image formed on the photo-sensitive material 12 can be satisfactorily transferred onto the recording sheet 17 with the transferring unit 16, which is delivered into the apparatus, and then the peeling unit 18, to which the constant current is supplied by the high voltage source 20, operates to discharge the recording sheet 17 to peel the latter of the photo-sensitive material 12.

In the case when the load resistance of the peeling unit 18 is decreased because of the installation error of the transferring unit 16 and the peeling unit 18, similarly as in the above-described case, the variation of the current can be minimized.

In the above-described current stabilizing circuit, the current stabilizing resistors R4 and Ra are provided in the charging unit 11 and the peeling unit 18, respectively, however, the invention is not limited thereto or thereby. That is, for instance, as shown in FIG. 2, the current stabilizing resistors R4 and Ra may be built in the high voltage source 20. In this case, the charging unit and the peeling unit can be used as they are, which contributes to the maintenance of the image recording apparatus.

As was described above, in the high voltage supply current stabilizing circuit according to the invention, the resistances of the first and second current stabilizing resistors are so selected as to be able to disregard the variation of the resistance of the peeling unit in the image recording apparatus, whereby the variation of the current flowing in the peeling unit is minimized. Hence, even when the resistance of the peeling unit changes, the current can be stably supplied to the peeling unit. Accordingly, with the stabilizing circuit, the difficulties accompanying the prior art are positively prevented that the toner image is not satisfactorily transferred on the recording sheet, the latter is not satisfactorily peeled off the photo-sensitive material, or toner explosion occurs.

While there has been described in connection with the preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An image recording apparatus having a current supplied from a high voltage source through a high supply current stabilizing circuit to a charging unit to charge a photosensitive material, said current being further supplied to a peeling unit to peel a printing sheet off of said photosensitive material on which an image has been recorded, said peeling unit having a resistance, and said high voltage supply current stabilizing circuit comprising:

a first resistive means for stabilizing said current supplied to said peeling unit to be constant, even when the resistance of the peeling unit fluctuates, said first resistance means having a resistance larger than said resistance of the peeling unit by a substantial amount; and a second resistive means for stabilizing said current supplied to said charging unit, said second resistive means comprising a resistor connected with respect to the first resistive means and the charging unit to improve the overall stability of said high voltage supply current stabilizing circuit.

2. An image recording apparatus having a current supplied from a high voltage source to a charging unit to charge a photosensitive material, said current being further supplied to a peeling unit to peel a printing sheet off of said photosensitive material on which an image has been recorded, said peeling unit having a resistance, and said high voltage source including a high voltage supply current stabilizing circuit comprising:

a first resistive means for stabilizing said current supplied to said peeling unit to be constant, even when the resistance of the peeling unit fluctuates, said first resistor means having a resistance larger than said resistance of the peeling unit by a substantial amount; and a second resistive means for stabilizing said current supplied to said charging unit to inhibit a toner explosion.

* * * * *